US008353124B1

(12) United States Patent
Zukowski et al.

(10) Patent No.: US 8,353,124 B1
(45) Date of Patent: Jan. 15, 2013

(54) THIXOTROPIC MOLDED BARREL FOR FIREARM

(75) Inventors: Gary Zukowski, Ludlow, MA (US); Brett Curry, Monson, MA (US); Steve Danneker, Westfield, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 13/430,954

(22) Filed: Mar. 27, 2012

(51) Int. Cl.
*F41A 21/02* (2006.01)

(52) U.S. Cl. ..... 42/76.02; 42/76.1

(58) Field of Classification Search ..... 42/76.02, 42/76.01, 77, 59, 78; 89/14.05, 16, 14.7
See application file for complete search history.

(56) References Cited

U.S. PATENT DOCUMENTS

| | | | | | |
|---|---|---|---|---|---|
| 2,137,259 | A | * | 11/1938 | Boak | 42/76.02 |
| 2,541,114 | A | * | 2/1951 | Somes | 89/14.05 |
| 3,004,361 | A | * | 10/1961 | Hammer | 42/76.02 |
| 4,769,938 | A | | 9/1988 | Chesnut et al. | |
| 4,911,060 | A | * | 3/1990 | Greenspan et al. | 89/14.05 |
| 5,040,589 | A | * | 8/1991 | Bradley et al. | 164/113 |
| 5,893,404 | A | | 4/1999 | Mendez et al. | |
| 6,330,761 | B1 | * | 12/2001 | Duval et al. | 42/59 |
| 6,564,856 | B1 | | 5/2003 | Buckley | |
| 6,574,898 | B2 | * | 6/2003 | Spencer et al. | 42/71.02 |
| 6,758,004 | B2 | * | 7/2004 | Huston | 42/76.02 |
| 7,152,357 | B2 | | 12/2006 | Huston | |
| 7,921,590 | B2 | | 4/2011 | Briggs | |
| 2010/0170129 | A1 | * | 7/2010 | Curry | 42/66 |
| 2011/0162246 | A1 | | 7/2011 | Briggs | |

* cited by examiner

*Primary Examiner* — Michael Carone
*Assistant Examiner* — Reginald Tillman, Jr.
(74) *Attorney, Agent, or Firm* — Ballard Spahr LLP; John A. Chionchio, Esq.

(57) ABSTRACT

A barrel for a firearm is formed of a tube surrounded by a shroud. The shroud is formed of a thixotropic alloy injection molded over the tube using a thixotropic molding process. The tube defines the firearm's bore and may be rifled.

35 Claims, 3 Drawing Sheets

THIXOTROPIC MOLDED BARREL FOR FIREARM

FIELD OF THE INVENTION

This invention concerns barrels for firearms.

BACKGROUND

Barrels for firearms are traditionally formed from a single material, such as steel, forged and then precision machined to tight tolerances. The barrel shape may be complex and require extensive machining, where final surface finish is important. Furthermore, the use of a single material often results in inefficient use of the material, as the barrel may be over designed from the point of view of yield strength and fatigue strength for overriding reasons of aesthetic design. Excess weight is an undesirable consequence of inefficient material use. These considerations are apparent, for example, in the design and manufacture of revolver barrels, whose shape is often complex, having various intersecting curved and flat surfaces, a recess for housing the ejector rod, and integrally formed front sights.

It would be advantageous to have a barrel for a firearm wherein the material is used more efficiently so as to provide adequate strength without excess weight, and wherein complex shapes and fine surface finish can be achieved without extensive machining.

SUMMARY

One aspect of the invention concerns a barrel for a firearm. In an example embodiment a barrel according to the invention comprises a tube defining a bore. The tube has first and second ends oppositely disposed. The tube may be rifled. The tube is formed of a first material. A shroud surrounds at least a portion of the tube. The shroud is formed of a second material, wherein the second material is a thixotropic alloy. The shroud is molded about the tube using a thixotropic molding process.

In the example barrel, a portion of the tube located at the first end may project outwardly from the shroud. A shoulder may be positioned on the tube. The shoulder projects outwardly from the tube and defines a shoulder surface oriented transversely to the centerline of the bore. The shoulder surface is positioned between the shroud and the portion of the tube projecting from the shroud. The shroud has a surface in contact with the shoulder surface.

In an example embodiment, the barrel may further comprise a projection attached to the tube. The projection extends outwardly from the tube and is positioned between the first and second ends of the tube. The projection may comprise at least one rib circumferentially surrounding the tube. The shroud contacts the at least one rib. In another example the projection comprises at least one rib extending lengthwise along the tube, the shroud contacting the at least one rib.

In an example barrel according to the invention the tube may have an outwardly facing surface wherein at least a portion of the outwardly facing surface is a knurled surface. An inwardly facing surface of the shroud is in contact with the knurled surface. The knurled surface may comprise a plurality of striations oriented lengthwise along the tube.

In a particular example barrel, the shroud comprises a projection projecting radially outwardly relatively to the bore. The projection may comprise a rib extending lengthwise parallel to the tube. The rib may have a surface angularly oriented with respect to a centerline of the tube. The shroud may also comprise an elongated recess positioned adjacent to the tube.

In another example embodiment of a barrel, the shroud has an outwardly facing surface. A portion of the outwardly facing surface proximate to the first end of the tube has helical threads for attachment of the barrel to the firearm.

In an example barrel according to the invention the first material may be selected from the group of metals including stainless steel, carbon steel and titanium. The second material may be selected from the group of thixotropic alloys consisting of aluminum, magnesium, manganese, silicon, iron, copper, nickel and combinations thereof.

The invention further encompasses a firearm comprising a barrel attached to a frame. In a particular example, the firearm is a revolver. In one example firearm embodiment, the barrel comprises a tube defining a bore. The tube has a breach end and a muzzle end oppositely disposed. The tube may be rifled. The tube is formed of a first material. The barrel also comprises a shroud that surrounds at least a portion of the tube. The shroud may include an elongated recess positioned adjacent to the tube. The shroud is formed of a second material, wherein the second material is a thixotropic alloy. The shroud is molded about the tube using a thixotropic molding process.

In one example embodiment, a portion of the tube located at the breach end projects outwardly from the shroud. The portion of the tube may comprise a forcing cone. The barrel may further comprise a shoulder positioned on the tube. The shoulder projects outwardly from the tube and defines a shoulder surface oriented transversely to the centerline of the bore. The shoulder surface is positioned between the shroud and the portion of the tube projecting from the shroud. The shroud has a surface in contact with the shoulder surface.

The example firearm according to an embodiment of the invention may further comprise a projection attached to the tube. The projection extends outwardly from the tube and is positioned between the shoulder and the muzzle end of the tube. The projection may comprise at least one rib circumferentially surrounding the tube, the shroud contacting the at least one rib. In another example, the projection may comprise at least one rib extending lengthwise along the tube. The shroud contacts the at least one rib.

In an example firearm the tube may have an outwardly facing surface. At least a portion of the outwardly facing surface is a knurled surface. An inwardly facing surface of the shroud is in contact with the knurled surface. The knurled surface may comprise a plurality of striations extending lengthwise along the tube.

The shroud may further comprise a sight positioned proximate to the muzzle end of the tube. The sight projects radially outwardly relatively to the bore. The sight may comprise, for example, a ramped blade sight.

In another example embodiment the shroud may have an outwardly facing surface wherein a portion of the outwardly facing surface proximate to the breach end of the tube has helical screw threads for attachment of the barrel to the frame of the firearm.

In an example firearm according to the invention the first material may be selected from the group of metals consisting of stainless steel, carbon steel and titanium. The second material may be selected from the group of thixotropic alloys consisting of aluminum, magnesium, manganese, silicon, iron, copper, nickel and combinations thereof.

The invention further encompasses a method of making a barrel for a firearm. In this method the barrel comprises a tube having an outwardly facing surface surrounded by a shroud. One example method comprises:

positioning the tube within a cavity defined by a mold, the cavity having an inwardly facing surface defining a shape of the shroud;

injecting a thixotropic alloy into the cavity between the outwardly facing surface of the tube and the inwardly facing surface of the mold;

allowing the thixotropic alloy to cool to a solid phase; and removing the barrel from the mold.

DETAILED DESCRIPTION

Figure 1:
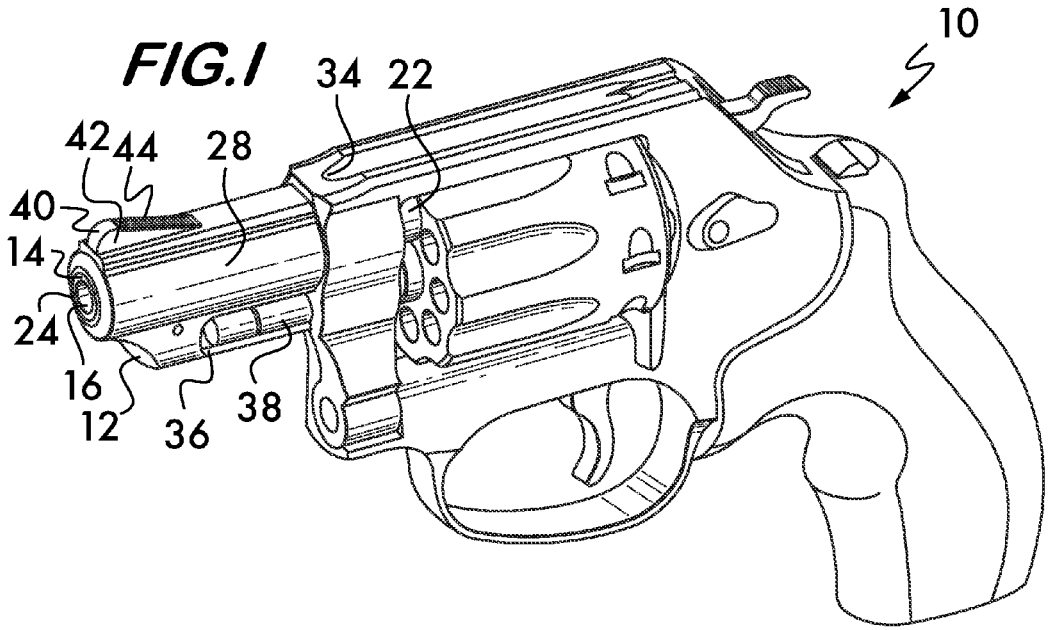
FIG. 1 is an isometric view of an example firearm having an example barrel embodiment according to the invention.
Figure 2:
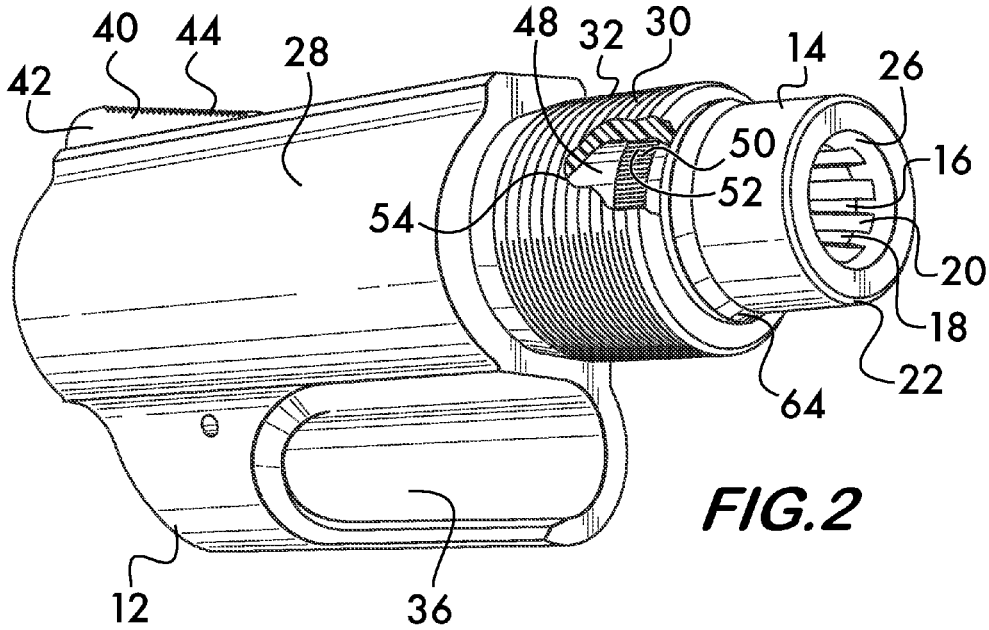
FIG. 2 is an isometric view of an example barrel embodiment on an enlarged scale.
Figure 3:
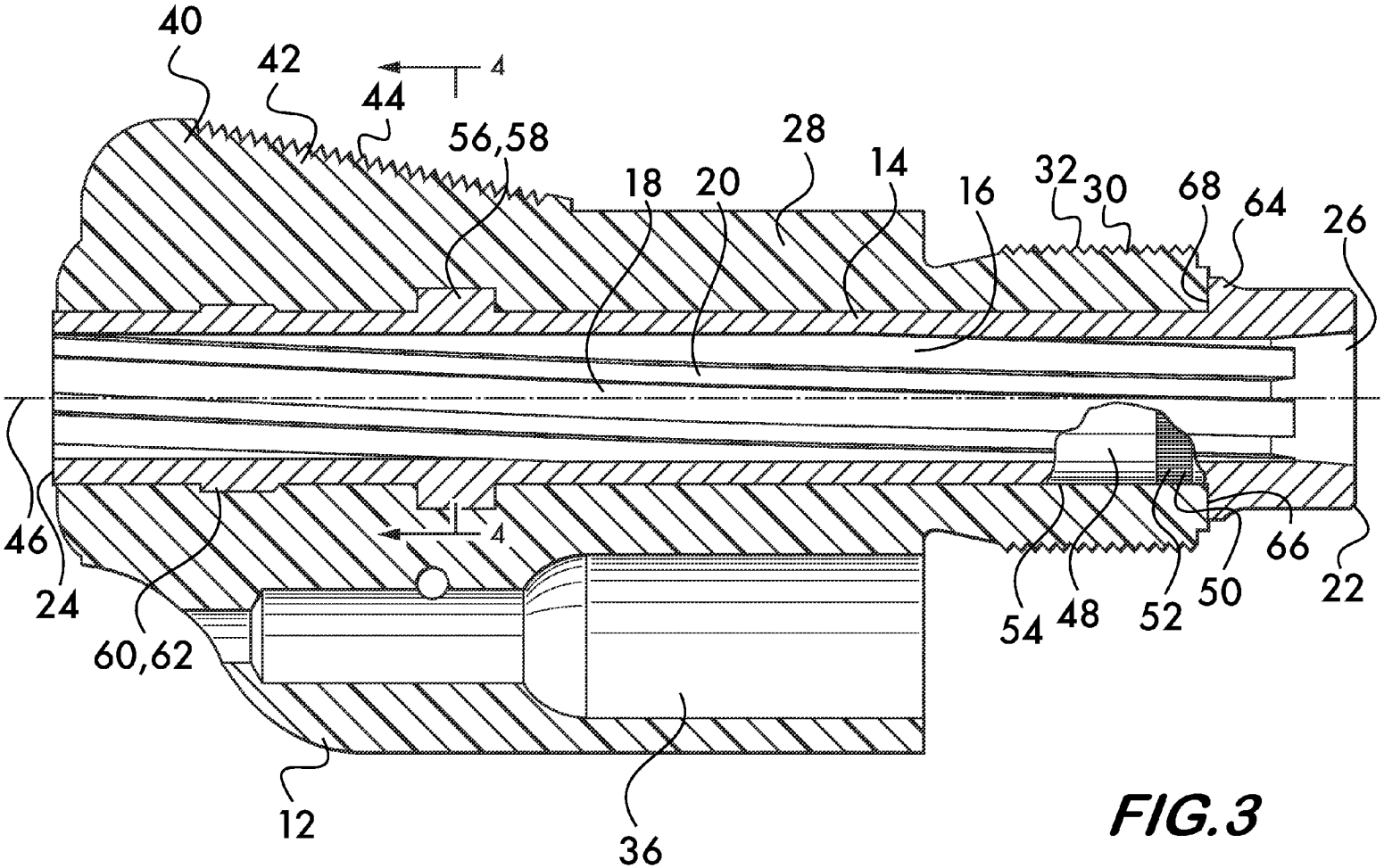
FIG. 3 is a longitudinal sectional view of an example barrel embodiment according to the invention.

FIG. 1 shows a firearm 10, in this example a revolver, having an example barrel embodiment 12 according to the invention. As shown in FIGS. 2 and 3, barrel 12 comprises a tube 14 defining a bore 16. Tube 14 is rifled, having grooves 18 and lands 20, and has a first or breach end 22 and a second or muzzle end 24. In this example barrel a forcing cone 26 is located at the breach end 22. Barrel 12 further comprises a shroud 28 which surrounds at least a portion of the tube 14. In this example the breach end 22 of the tube 14 projects outwardly from the shroud 28. An outer surface 30 on shroud 28 has helical screw threads 32 to facilitate attachment of the barrel to the frame 34 of the firearm 10 as shown in FIG. 1. Shroud 28 also has an elongated recess 36 positioned adjacent to the tube 14. Recess 36 receives the ejector rod 38 of the revolver 10. Barrel 12 also has a sight 40 integrally formed with the shroud 28. Sight 40 may comprise any type of projection located proximate to the muzzle end 24 of tube 14 and projecting radially outwardly relative to the bore 16 of the tube 14. In this example a ramped blade sight is depicted, the sight 40 comprising a rib 42 extending lengthwise parallel to the tube and having a surface 44 oriented angularly with respect to the centerline 46 of the tube 14. It is also feasible to have other types of sights integrally formed with the shroud, such as bead sights. Shroud 28 may also be formed without a sight, and a sight may be attached as a separate piece.

Tube 14 is formed of a material different from the material forming the shroud 28. The tube material is chosen for strength, ability to tolerate high temperatures, and durability, as it must withstand the heat of the flame front of the cartridge discharge, the high gas pressure of the burning propellant, and the friction between the tube 14 and the projectile as it traverses the bore 16. To this end the tube 14 may be formed from stainless steel, for example 400 series, as well as carbon steel or titanium.

Shroud 28 is formed of a thixotropic alloy which can be thixotropically molded about the tube. Such materials include metal alloys comprising aluminum, magnesium, manganese, silicon, iron, copper, nickel and other trace elements. Suitable alloys are commercially available from AFT (Advanced Forming Technologies) of Longmont, Colo. In particular, an alloy with the commercial designation of AZ91D from AFT has been successfully used to form barrels according to the invention. Alloy AZ91D comprises 8.3-9.7 wt % aluminum, 0.35-1.0 wt % zinc, 15-0.5% manganese, up to 0.10 wt % silicon, up to 0.005 wt % iron, up to 0.030 wt % copper, up to 0.002 wt % nickel, up to 0.02 wt % metallic impurities, the remainder of the composition being magnesium.

Thixotropic alloys are used with thixotropic molding techniques to form precision castings having complex shapes and requiring fine surface finishes. Thixotropic alloys are multi-component metal alloys wherein one metallic component, which constitutes the minority constituent of the alloy, has a lower melting point temperature than the other metal or metals forming the alloy. The thixotropic alloy can thus be heated to a semi-solid phase wherein only the minority metal constituent melts. The resultant alloy is soft, will flow as a liquid when subjected to shear forces and thus can be injection molded into a complex mold but yield the quality of a forging. U.S. Pat. No. 6,564,856 entitled "Method of Making Precision Castings Using Thixotropic Materials" is hereby incorporated by reference herein and describes in detail the characteristics of thixotropic alloys and thixotropic molding techniques.

Various advantages are secured by forming the barrel 12 from a separate tube 14 and shroud 28 of dissimilar materials. For example, more efficient use of material is possible, as the entire barrel need not be made from expensive and difficult to machine steel alloy. The tube 14, which represents a relatively smaller part of the barrel 12, may be designed to withstand the high pressures, temperatures and friction encountered during use. In contrast, the shroud 28, which forms the bulk of the barrel volume and which is not subjected to the harsh conditions seen by the tube, is designed for aesthetic purposes as well as minor functional purposes, such as providing a front sight. Thus the composite design allows the minimum amount of the proper material to be used to greatest effect. Additionally, use of a thixotropically moldable alloy permits the barrel 12 to assume complex shapes which would otherwise be prohibitively expensive to machine, or, which may not be achievable by machining. Furthermore, the composite design allows for a lighter weight barrel, as the majority of the barrel volume can be molded from a lighter weight alloy than if the barrel were entirely steel. In the example alloy described herein, the thixotropic alloy comprising the shroud 28 has a density of 0.066 lbs/in$^3$ (1.81 g/cm$^3$) whereas stainless steel has a density of about 0.29 lbs/in$^3$ (8.03 g/cm$^3$).

Figure 4:
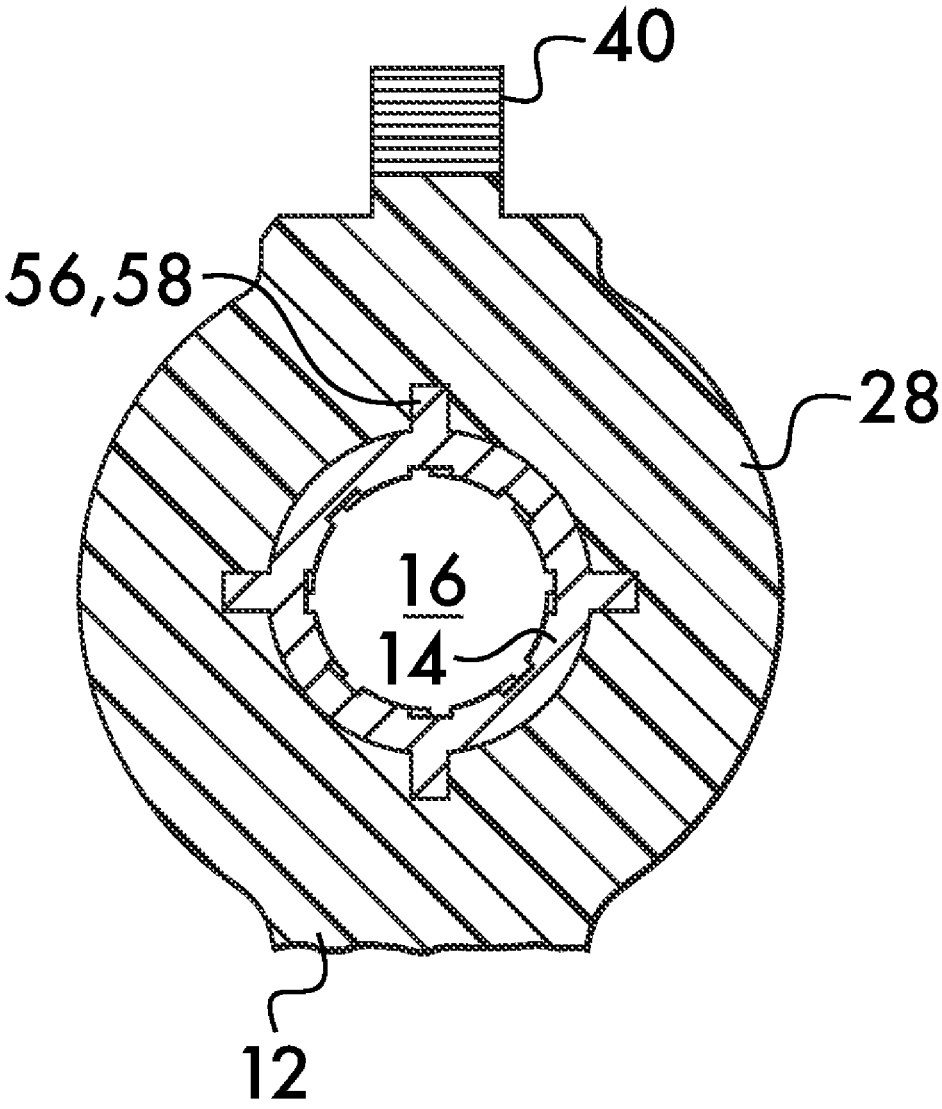
FIG. 4 is a cross sectional view of the example barrel embodiment taken at line 4-4 of FIG. 3.

Because the barrel 12 comprises a tube 14 and a shroud 28 formed of dissimilar materials and united in a molding process, it is advantageous to provide features ensuring positive mechanical engagement between the tube and shroud. For example, as shown in FIGS. 2 and 3, the outwardly facing surface 48 of the tube 14 may comprise a knurled surface portion 50. The knurled surface 50 in this example comprises a plurality of striations 52 extending circumferentially around and oriented lengthwise along tube 14. Physical contact between the inwardly facing surface 54 of the shroud 28 and the striations 52 of knurled surface portion 50 provides positive mechanical engagement which resists relative rotation between the tube 14 and the shroud 28 about the tube centerline 46 as occurs during firing of the revolver as a reaction torque to the torque exerted by the rifling on the projectile. As shown in FIGS. 3 and 4, in addition to or in place of the knurled surface portion 50, one or more projections 56 in the form of ribs 58 may extend outwardly from and lengthwise along tube 14. Shroud 28 contacts the rib or ribs 58 for positive mechanical engagement resisting the relative rotation between tube and shroud as occurs during firing of the revolver as a reaction torque to the torque exerted by the rifling on the projectile.

Projections from tube 14 may also be used to resist relative axial motion (motion along the centerline 46) between the shroud 28 and the tube 14. For example, as shown in FIG. 3, a projection 60 in the form of a rib 62 extends outwardly from the tube 14. Rib 62 circumferentially surrounds the tube 14 and the shroud 28 surrounds the rib. Physical contact between the shroud 28 and the rib 62 resists relative axial motion between the tube 14 and the shroud 28 as occurs during firing of the revolver as the projectile enters the forcing cone 26 and engages the rifling. Additionally, the tube 14 may have a shoulder 64. In the example embodiment shown in FIG. 3, the shoulder 64 projects outwardly from tube 14 and defines a shoulder surface 66 oriented transversely to the centerline 46 of the bore 16. The shoulder surface 66 is positioned between the shroud 28 and the breach end 22 of tube 14 which projects outwardly from the shroud. The shroud 28 has a surface 68 that contacts the shoulder surface 66. Contact between the shroud surface 68 and the shoulder surface 66 resists relative axial motion between the shroud and tube as occurs during firing of the revolver as the projectile enters the forcing cone 26 and engages the rifling.

The invention further encompasses a method of making a barrel for a firearm. In one example embodiment, the method comprises:

positioning the tube 14 within a cavity defined by a mold, the cavity having an inwardly facing surface defining the shape of the shroud 28;

injecting a thixotropic alloy into the cavity between the outwardly facing surface 46 of the tube 14 and the inwardly facing surface of the mold;

allowing the thixotropic alloy to cool to a solid phase; and removing the barrel 12 from the mold.

Additional method steps for finishing the barrel may include removing flash or sprue from the shroud which might form during the molding process, machining of minor details such as holes and the screw threads 32, passivating the surface of the shroud, anodizing the surface of the shroud, and applying a final protective coating to the shroud, such as paint containing polytetrafluoroethylene.

Barrels according to the invention provide significant advantages over barrels according to the prior art as they permit more efficient use of materials, provide for a lighter weight firearm, and reduce the need for machining of complex parts.

What is claimed is:

1. A barrel for a firearm, said barrel comprising:

a tube defining a bore, said tube having first and second ends oppositely disposed, said tube being formed of a first material;

a shroud surrounding at least a portion of said tube, said shroud being formed of a second material, wherein said second material is a thixotropic alloy.

2. The barrel according to claim 1, wherein a portion of said tube located at said first end projects outwardly from said shroud.

3. The barrel according to claim 2, further comprising a shoulder positioned on said tube, said shoulder projecting outwardly from said tube and defining a shoulder surface oriented transversely to a centerline of said bore, said shoulder surface being positioned between said shroud and said portion of said tube projecting from said shroud, said shroud having a surface in contact with said shoulder surface.

4. The barrel according to claim 1, further comprising a projection attached to said tube and extending outwardly therefrom, said projection being positioned between said first and second ends of said tube.

5. The barrel according to claim 4, wherein said projection comprises at least one rib circumferentially surrounding said tube, said shroud contacting said at least one rib.

6. The barrel according to claim 4, wherein said projection comprises at least one rib extending lengthwise along said tube, said shroud contacting said at least one rib.

7. The barrel according to claim 1, wherein said tube has an outwardly facing surface, at least a portion of said outwardly facing surface being a knurled surface, an inwardly facing surface of said shroud being in contact with said knurled surface.

8. The barrel according to claim 7, wherein said knurled surface comprises a plurality of striations oriented lengthwise along said tube.

9. The barrel according to claim 1, wherein said shroud comprises a projection projecting radially outwardly relatively to said bore.

10. The barrel according to claim 9, wherein said projection comprises a rib extending lengthwise parallel to said tube, said rib having a surface angularly oriented with respect to a centerline of said tube.

11. The barrel according to claim 1, wherein said shroud comprises an elongated recess positioned adjacent to said tube.

12. The barrel according to claim 1, wherein said shroud has an outwardly facing surface, a portion of said outwardly facing surface proximate to said first end of said tube having helical threads for attachment of said barrel to said firearm.

13. The barrel according the claim 1, wherein said first material is selected from the group of metals consisting of stainless steel, carbon steel and titanium.

14. The barrel according to claim 1, wherein said second material is selected from the group of thixotropic alloys consisting of aluminum, magnesium, manganese, silicon, iron, copper, nickel and combinations thereof.

15. The barrel according to claim 1, wherein said tube is rifled.

16. The barrel according to claim 1, wherein said shroud is molded about said tube using a thixotropic molding process.

17. A firearm comprising a barrel attached to a frame, said barrel comprising:

a tube defining a bore, said tube having a breach end and a muzzle end oppositely disposed, said tube being formed of a first material;

a shroud surrounding at least a portion of said tube, said shroud being formed of a second material, wherein said second material is a thixotropic alloy.

18. The firearm according to claim 17, wherein a portion of said tube located at said breach end projects outwardly from said shroud.

19. The firearm according to claim 18, wherein said portion of said tube comprises a forcing cone.

20. The firearm according to claim 18, further comprising a shoulder positioned on said tube, said shoulder projecting outwardly from said tube and defining a shoulder surface oriented transversely to a centerline of said bore, said shoulder surface being positioned between said shroud and said portion of said tube projecting from said shroud, said shroud having a surface in contact with said shoulder surface.

21. The firearm according to claim 20, further comprising a projection attached to said tube and extending outwardly therefrom, said projection being positioned between said shoulder and said muzzle end of said tube.

22. The firearm according to claim 21, wherein said projection comprises at least one rib circumferentially surrounding said tube, said shroud contacting said at least one rib.

23. The firearm according to claim 21, wherein said projection comprises at least one rib extending lengthwise along said tube, said shroud contacting said at least one rib.

24. The firearm according to claim 17, wherein said tube has an outwardly facing surface, at least a portion of said outwardly facing surface being a knurled surface, an inwardly facing surface of said shroud being in contact with said knurled surface.

25. The firearm according to claim 24, wherein said knurled surface comprises a plurality of striations extending lengthwise along said tube.

26. The firearm according to claim 17, wherein said shroud comprises a sight positioned proximate to said muzzle end of said tube, said sight projecting radially outwardly relatively to said bore.

27. The firearm according to claim 26, wherein said sight comprises a ramped blade sight.

28. The firearm according to claim 17, wherein said shroud has an outwardly facing surface, a portion of said outwardly facing surface proximate to said breach end of said tube having helical screw threads for attachment of said barrel to said frame.

29. The firearm according the claim 17, wherein said first material is selected from the group of metals consisting of stainless steel, carbon steel and titanium.

30. The firearm according to claim 17, wherein said second material is selected from the group of thixotropic alloys consisting of aluminum, magnesium, manganese, silicon, iron, copper, nickel and combinations thereof.

31. The firearm according to claim 17, wherein said tube is rifled.

32. The firearm according to claim 17, wherein said firearm is a revolver.

33. The firearm according to claim 32, wherein said shroud comprises an elongated recess positioned adjacent to said tube.

34. The firearm according to claim 17, wherein said shroud is molded about said tube using a thixotropic molding process.

35. A method of making a barrel for a firearm, said barrel comprising a tube having an outwardly facing surface surrounded by a shroud, said method comprising:

positioning said tube within a cavity defined by a mold, said cavity having an inwardly facing surface defining a shape of said shroud;

injecting a thixotropic alloy into said cavity between said outwardly facing surface of said tube and said inwardly facing surface of said mold;

allowing said thixotropic alloy to cool to a solid phase; and removing said barrel from said mold.

* * * * *